US006001050A

United States Patent [19]

Delf

[11] Patent Number: 6,001,050

[45] Date of Patent: Dec. 14, 1999

[54] EXERCISE DEVICE

[76] Inventor: Eric William Delf, 10 Hall Lane, Sandon, Chelmsford, CM2 7RQ, United Kingdom

[21] Appl. No.: 08/899,954

[22] Filed: Jul. 24, 1997

[30] Foreign Application Priority Data

Jul. 25, 1996 [GB] United Kingdom ..... 96156369

[51] Int. Cl.[6] ..... A63B 21/02

[52] U.S. Cl. ..... 482/122; 482/44; 482/128; 482/909

[58] Field of Search ..... 482/44, 45, 46, 482/47, 48, 49, 121, 122, 123, 124, 125, 126, 128, 129, 130, 909

[56] References Cited

U.S. PATENT DOCUMENTS

| | | | |
|---|---|---|---|
| 2,494,094 | 1/1950 | Horstman | 482/128 |
| 3,003,764 | 10/1961 | Yovanovitch | 482/128 |
| 3,497,216 | 2/1970 | Feather | 482/128 |
| 3,822,061 | 7/1974 | Sigma . | |
| 5,050,875 | 9/1991 | Lekovich | 482/909 |
| 5,141,481 | 8/1992 | Kolbel | 482/909 |
| 5,145,473 | 9/1992 | Henry . | |
| 5,222,926 | 6/1993 | Eggen . | |
| 5,431,616 | 7/1995 | Centofante | 482/909 |

FOREIGN PATENT DOCUMENTS

| | | |
|---|---|---|
| 209303 A2 | 1/1987 | European Pat. Off. . |
| 821105 | 9/1959 | United Kingdom . |
| 1233394 | 5/1971 | United Kingdom . |
| 2188711 | 10/1987 | United Kingdom . |
| 2252921 | 8/1992 | United Kingdom . |

*Primary Examiner*—Lynne A. Reichard
*Attorney, Agent, or Firm*—Miller, Sisson, Chapman & Nash, P.C.

[57] ABSTRACT

An exercise device comprises first and second members connected together by spring means so as to be movable towards each other by the application of a compressive force therebetween or to be movable away from each other by the application of a tensile force to said members. A sounder is provided on one member which, on contact with a striker surface on the other member, emits a warning sound. The striker surface is adjustable towards and away from said sounder so that the warning sound is emitted when a selected predetermined force is applied to the members.

10 Claims, 2 Drawing Sheets

EXERCISE DEVICE

FIELD OF THE INVENTION

The present invention relates to exercise devices.

BACKGROUND TO THE INVENTION

Many existing exercise devices have disadvantages to the user. They are often expensive, complicated, heavy, bulky, unsafe, ineffective, and inconvenient to store, transport and use, with a limited range of exercises.

Examples of prior art exercise devices are disclosed in GB-A-821105, GB-A-1233394, U.S. Pat. No. 3,822,061, GB-A-2188711, GB-A-2252921, EP-A-0209303 and U.S. Pat. No. 5,222,926. U.S. Pat. No. 5,145,473 discloses a relatively simple hand-held exerciser of the general type with which the invention in concerned, but having no facility for the user to adjust the set load to vary the exercise effect.

The present invention seeks to provide an inexpensive, simple, light, compact, safe effective and versatile exercise device, conveniently portable and easy to use, with a large range of exercises.

The present invention provides a means of determining the load applied to a muscle for isometric contraction (contraction without significant joint movement).

SUMMARY OF THE INVENTION

According to the invention, there is provided an exercise device, comprising first and second members connected together by spring means so as to be moveable towards each other by the application of a compressive force therebetween or to be movable away from each other by the application of a tensile force to said members, and a sounder on one member which, on contact with a striker surface on the other member, emits a warning sound, the striker surface being adjustable towards and away from said sounder so that the warning sound is emitted when a selected predetermined force is applied to the members.

In its simplest embodiment the present invention provides two pressure plates connected by spring means. Adjustment means are provided to vary the degree of pressure required, acting on the said pressure plates, to operate the said sounder.

In use, the exercise device herein described is squeezed between different parts of the user's body, or the user's body and an immovable surface, until a warning sound is generated indicating that the desired muscle load has been reached.

The sounder may be a vane or vanes which produce an audible click when deflected, or a reed or reeds producing an audible vibration when plucked.

More than one sounder may be provided, or the sounder may be designed to produce multiple signals corresponding to different degrees of pressure applied to the said pressure plates.

The device of the invention may be made small enough to fit into the user's pocket, permitting it to be carried for use wherever the user may be, and at any time. It is suitable for use by people of all ages and abilities, including the partially disabled. There is no risk to the user from weights, springs or rubber bands, as with conventional exercise devices.

BRIEF DESCRIPTION OF THE DRAWINGS

Exemplary embodiments will now be described, with reference to the accompanying drawings, in which.

DETAILED DESCRIPTION OF THE ILLUSTRATED EMBODIMENT

Figure 1:
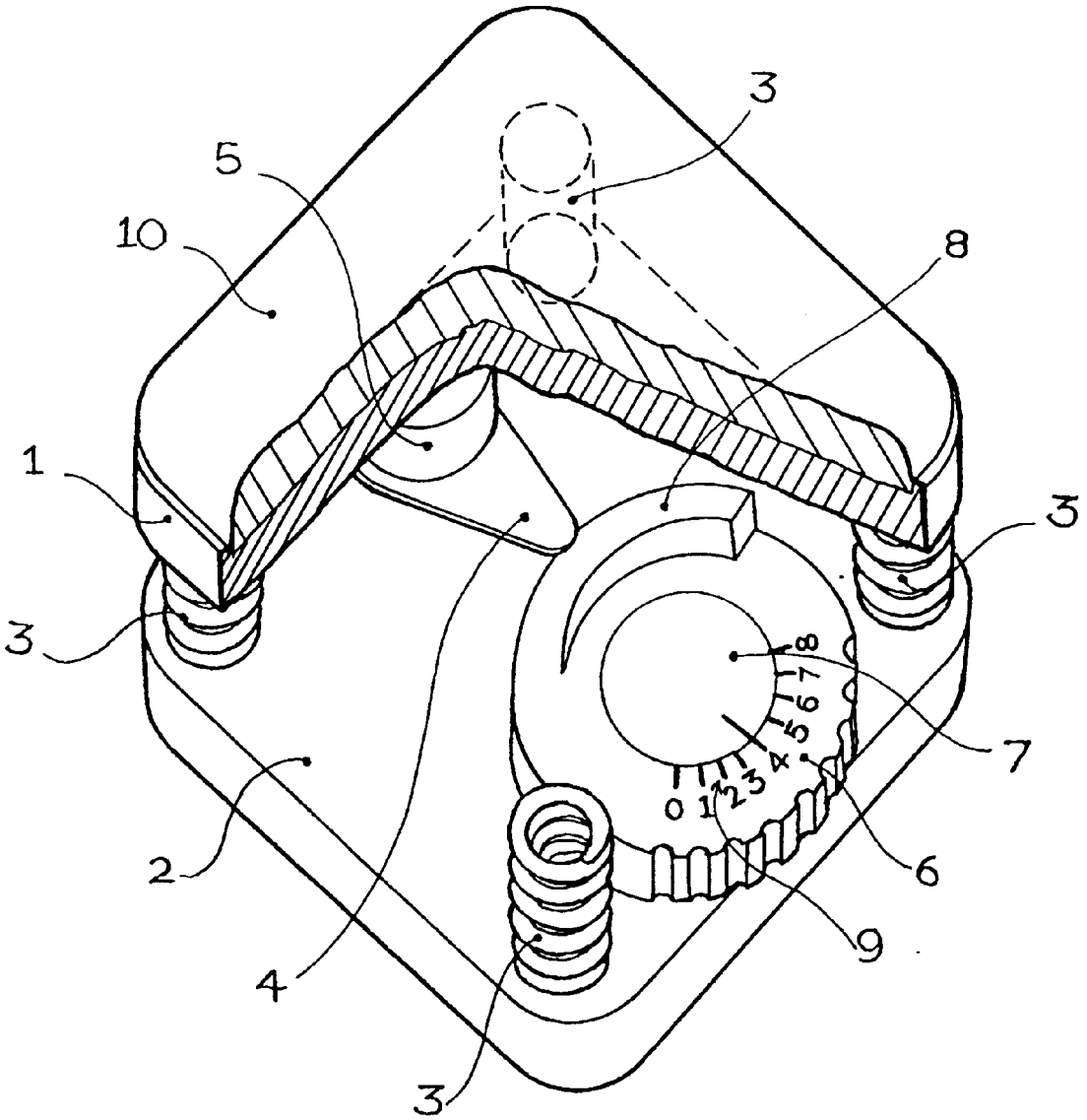
FIG. 1 is a perspective cutaway view of the exercise device.

Referring to FIG. 1, pressure plates 1 and 2 are connected together by springs 3. A click vane 4 is connected to one pressure plate 1 via a spacing block 5. A disc 6 is retained by, and is free to rotate round, a spindle 7 which is attached to the second plate 2. The disc 6 incorporates an inclined plane or cam 8 at its periphery and a load setting scale 9. The disc 6 is positioned on the second plate 2 so that its periphery falls at or near the centre and also the edge of the plate 2. The vane 4 is positioned at or near the centre of the first plate 1 so that it may make contact with the inclined plane on the disc 6 when the plates 1 and 2 are squeezed together. The disc 6 may embody a simple click stop or friction control mechanism (not shown). Flexible pads 10 may be provided on the plates 1 and 2 or they may be suitably contoured for user comfort.

In use, the disc 6 is rotated by finger or thumb to a desired load setting on the scale 9. Rotation of the disc 6 has the effect of altering the gap between the inclined plane or cam 8 and the vane 4. The pressure plates 1 and 2 are squeezed together, for example between the hands of the user, causing compression of the springs 3 until the vane 4 is deflected by pressure against the inclined plane 8. This produces an audible click which signals to the user that the desired muscle loading has been attained.

Figure 2:
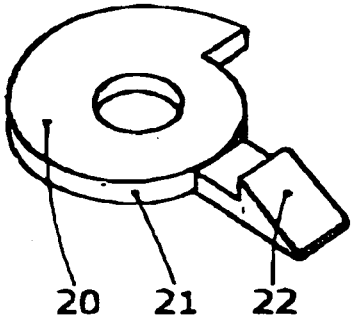
FIGS. 2 to 4 are illustrations of alternative cam mechanisms to that shown in FIG. 1.

FIG. 2 shows a first alternative embodiment of the cam mechanism, in which a rotary cam 20 has an outwardly-directed spiral cam surface 21, which engages a slidable striker member 22 having the form of a ramp. The striker member is spring-biased (the spring is not shown for clarity, but may be arranged at any suitable position so as to locate at one end on a fixed point of one member of the device, and at the other end on the striker member 22) into engagement with the cam surface 21. As the cam 20 is rotated, the cam surface 21 causes the striker member to move towards or away from the centre of the cam, depending on the direction of rotation, so that the point on the ramp which is struck by the sounder moves away from or towards the sounder, thus increasing or decreasing the load necessary to cause the sounder to emit a sound.

Figure 3:
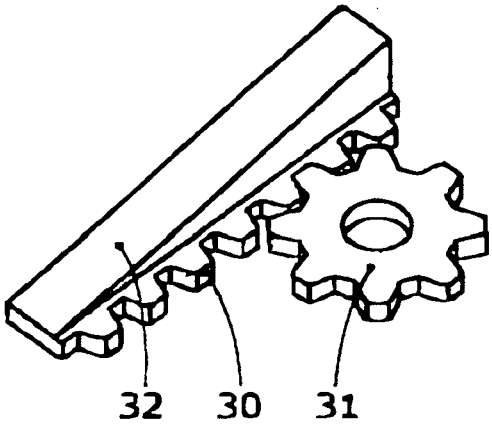

The arrangement of FIG. 3 provides a rack 30 and pinion 31 to slide the ramp 32 so as to vary the distance from the sounder. An externally accessible adjustment wheel may be provided with a gear meshing with the pinion 31 so that rotation of the wheel causes rotation of the pinion and thus linear movement of the striker member 30, 32. The result is again a variation in the required force to sound the sounder.

Figure 4:
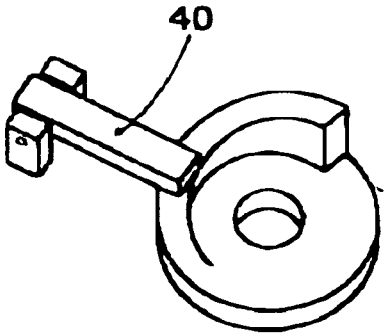

In the arrangement of FIG. 4, the disc with the inclined plane shown in FIG. 1 is engaged by a hinged secondary member 40 which serves as the striker to be engaged by the sounder or vane 4 when the device is compressed.

I claim:

1. A portable isometric exercise device, comprising first and second members connected together by spring means so as to be movable towards each other by the application of a compressive force on said first and second members therebetween, and a sounder on one member which, on contact with a striker surface on the other member, emits a warning sound, said striker surface being adjustable towards and away from said sounder so that said warning sound is emitted when a selected predetermined compressive force is applied to said members.

2. A device according to claim 1, wherein the adjustable striker surface is in the form of a rotatable circular cam.

3. A device according to claim 2, wherein the cam is rotatable by means of a roughened peripheral portion thereof projecting laterally of the device between the members.

4. A device according to claim 2, comprising a scale of indications on the cam movable relative to a fixed marker.

5. A device according to claim 4, wherein the marker is provided on a central spindle mounting the cam.

6. A device according to claim 1, wherein the sounder is arranged to produce multiple signals corresponding to different degrees of force applied to the members.

7. A device according to claim 1, comprising a plurality of sounders arranged to produce sounds corresponding to a plurality of different predetermined loads on the device.

8. A device according to claim 1, wherein the members are in the form of plates to which pressure can be applied manually.

9. A device according to claim 8, wherein the plates are provided with resilient padding thereon.

10. A device according to claim 1, wherein said device is dimensioned and arranged to be hand-held.

* * * * *